US006405506B2

(12) United States Patent
Ruff

(10) Patent No.: US 6,405,506 B2
(45) Date of Patent: Jun. 18, 2002

(54) DOOR FRAME FOR METAL BUILDINGS

(75) Inventor: Robert O. Ruff, Cincinnati, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/767,078

(22) Filed: Jan. 22, 2001

Related U.S. Application Data

(63) Continuation-in-part of application No. 09/273,406, filed on Mar. 22, 1999, now abandoned.

(60) Provisional application No. 60/078,949, filed on Mar. 23, 1998.

(51) Int. Cl.[7] ..... E06B 1/04

(52) U.S. Cl. ..... 52/656.4; 52/204.1; 52/656.7; 49/504

(58) Field of Search ..... 52/204.1, 656.7, 52/656.4, 656.2, 210; 49/504, 505

(56) References Cited

U.S. PATENT DOCUMENTS

| | | | | | |
|---|---|---|---|---|---|
| 2,687,194 | A | * | 8/1954 | Kelly | 52/204.53 |
| 2,741,344 | A | | 4/1956 | Herr | |
| 3,103,263 | A | | 9/1963 | Leeser | |
| 3,287,857 | A | * | 11/1966 | Dukas | 49/504 |
| 3,299,592 | A | | 1/1967 | Cable | |
| 3,385,004 | A | | 5/1968 | Oehler et al. | |
| 3,429,076 | A | | 2/1969 | Fortsch et al. | |
| 3,571,996 | A | * | 3/1971 | Braswell | 52/212 |
| 3,690,082 | A | * | 9/1972 | Byland | 52/213 |
| 3,769,773 | A | | 11/1973 | Mochizuki | |
| 3,924,373 | A | | 12/1975 | Lizdas et al. | |
| 4,015,382 | A | | 4/1977 | Noyes | |
| 4,034,514 | A | * | 7/1977 | Cecil | 49/504 |
| 4,223,494 | A | * | 9/1980 | Wendt | 52/211 |
| 4,614,068 | A | * | 9/1986 | Bergthold | 52/211 |
| 4,674,248 | A | | 6/1987 | Hall | |
| 4,698,944 | A | | 10/1987 | Wilkins, Jr. | |
| 5,187,909 | A | * | 2/1993 | Olson | 52/308 |
| 5,392,565 | A | * | 2/1995 | Rentschler | 49/504 |
| 5,581,953 | A | | 12/1996 | Ruff | |
| 5,603,191 | A | * | 2/1997 | Wu | 52/204.1 |
| 5,619,823 | A | | 4/1997 | Ruff et al. | |
| 6,041,565 | A | * | 3/2000 | Reitz et al. | 52/656.4 |
| 6,148,572 | A | * | 11/2000 | Ruff | 52/204.1 |

* cited by examiner

*Primary Examiner*—Carl D. Friedman
*Assistant Examiner*—Brian E. Glessner
(74) *Attorney, Agent, or Firm*—Michael Best & Friedrich LLP

(57) ABSTRACT

A pre-hung door and door frame in combination with nesting door posts. Preferably, the door posts have a central channel extending into contact with a door jamb soffit and one of the door jamb stops. The header includes a header tab extending from a nailing flange into a area defined by the door jamb rabbet, face and back bends to provide a more rigid connection between the header and the door jamb. The header also includes a pair of door jamb tabs integral with the header for securing the header relative to the door jambs.

15 Claims, 8 Drawing Sheets

DOOR FRAME FOR METAL BUILDINGS

This application is a continuation-in-part of U.S. patent application Ser. No. 09/273,406, filed Mar. 22, 1999, now abandoned which claims the benefit under 35 U.S.C. § 119 (e) of U.S. provisional application Ser. No. 60/078,949, filed Mar. 23, 1998.

BACKGROUND OF THE INVENTION

This invention relates generally to door frames and more particularly to pre-hung doors and frames for metal buildings.

Referring to FIGS. 1–3, a pre-engineered metal building wall 100 is shown with a doorway opening 102 cut therein. In many applications, a door frame 104 is positioned within the opening 102 and secured to the building wall 100 by a door post 106 secured to each door jamb 108. A girt 112 typically is provided above the upper edge of the opening 102 for securing of the posts 106 for additional rigidity. However, since the girt 112 is typically positioned above the frame height and the posts 106 are typically only the height of the frame 104, long anchors 114, which often are susceptible to flexing, are required to secure the posts 106 to the girt 112. Additionally, a header reinforcement 116 may have to be secured to the frame header 110 for additional support.

In many pre-engineered metal buildings, door frames 104 are assembled at the job site by installing the frame sections and then hanging the door. Such installations are labor intensive and the resulting door and door frames can have insufficient resistance to twisting of the frames. Even in applications wherein the frame 104 is preassembled, the frames 104 still generally include a number of post-manufacture clips and anchors 118 for assembling the frame 104 and securing it to the door posts 106. As a result, the manufacturing time and costs are increased and the resultant number of components also create more difficult assembly and greater risk of component failure. Additionally, the numerous clips and anchors 118 and the door posts 106 often make it difficult to easily and efficiently insulate the door jambs 108.

The foregoing illustrates limitations known to exist in present door frames 104 for pre-engineered buildings. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pre-hung door and frame comprising: a header; two door jambs at a right angle to the header, each door jamb comprising an elongated member having a soffit, two stops extending at right angles from the soffit, a rabbet extending at a right angle from each stop and a face extending at a right angle from each rabbet, an upper end of each door jamb being attached to the header; and a door hingedly attached to one of the door jambs; and two door posts, the door posts nesting within and secured to the door jambs.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Shown in the FIGURES is a steel door frame for prefabricated (or pre-engineered) metal buildings. Preferably, the door frame is used for pre-hung doors. Benefits of this steel door frame include reduced number of parts, subassemblies and fasteners; improved strength and security; easier installation of insulation inside door jambs (insulation does not need to be compressed behind door post at jambs reducing its insulating properties); fewer fasteners required to install door and frame; increased strength of door jambs and frame mounting due to longer door posts (typical door posts are the same height as the door frame and are fastened to girt above with long anchors that can flex); and easier reversal of the handing of the frame by slotted holes in the ends of the jambs and some adjustment for uneven floor when installed (handing of the frame can be changed easily by just loosening the screws in the ends of the head and the sill and sliding them out of the slots in the ends of the jambs).

The head is made in one piece with integral end tabs for assembly and integral header reinforcement. Typical heads consist of head with welded in end clips for assembly and two welded zee anchors to mount header reinforcement. One part replaces six parts.

Typical jambs have four welded in zee anchors to mount door posts. The new door post has a profile that fits inside the jambs without the use of anchors and fastens directly to, preferably, the soffit of the jambs. The door post profile has a deep channel shape at the center which greatly increases its strength and the strength of the jamb when installed. The channeled area can also be used to install the wall insulation in the jambs without compressing it as is presently done for typical jambs and post combinations.

Figure 1:
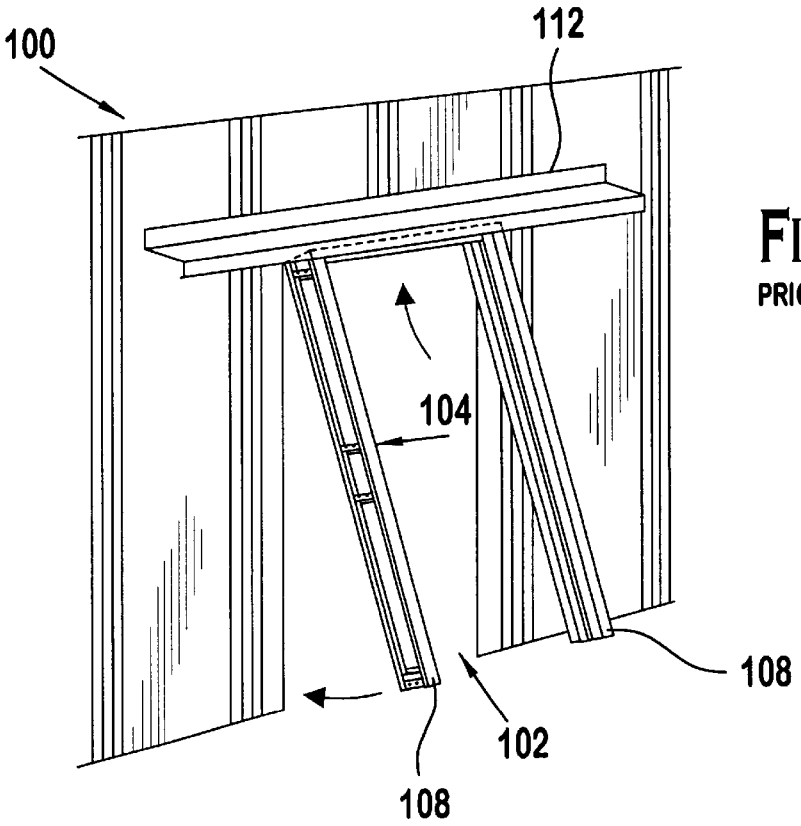
FIG. 1 PRIOR ART
FIG. 1 is a perspective view illustrating installation of a prior art door frame in a pre-engineered metal building door opening.
Figure 2:
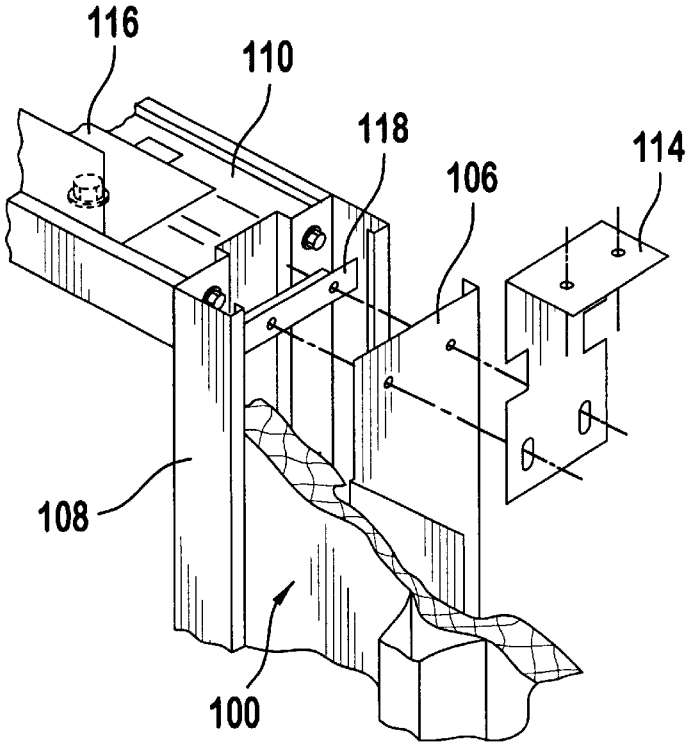
FIG. 2 PRIOR ART
FIG. 2 is a perspective view illustrating a prior art frame positioned within a door opening and being secured by a prior art door post.
Figure 3:
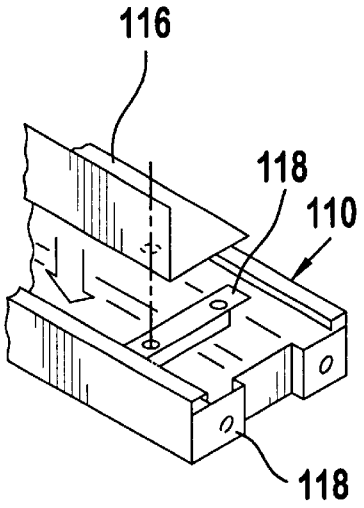
FIG. 3 PRIOR ART
FIG. 3 is a perspective view illustrating the attachment of a prior art header reinforcement to a prior art header.
Figure 4:
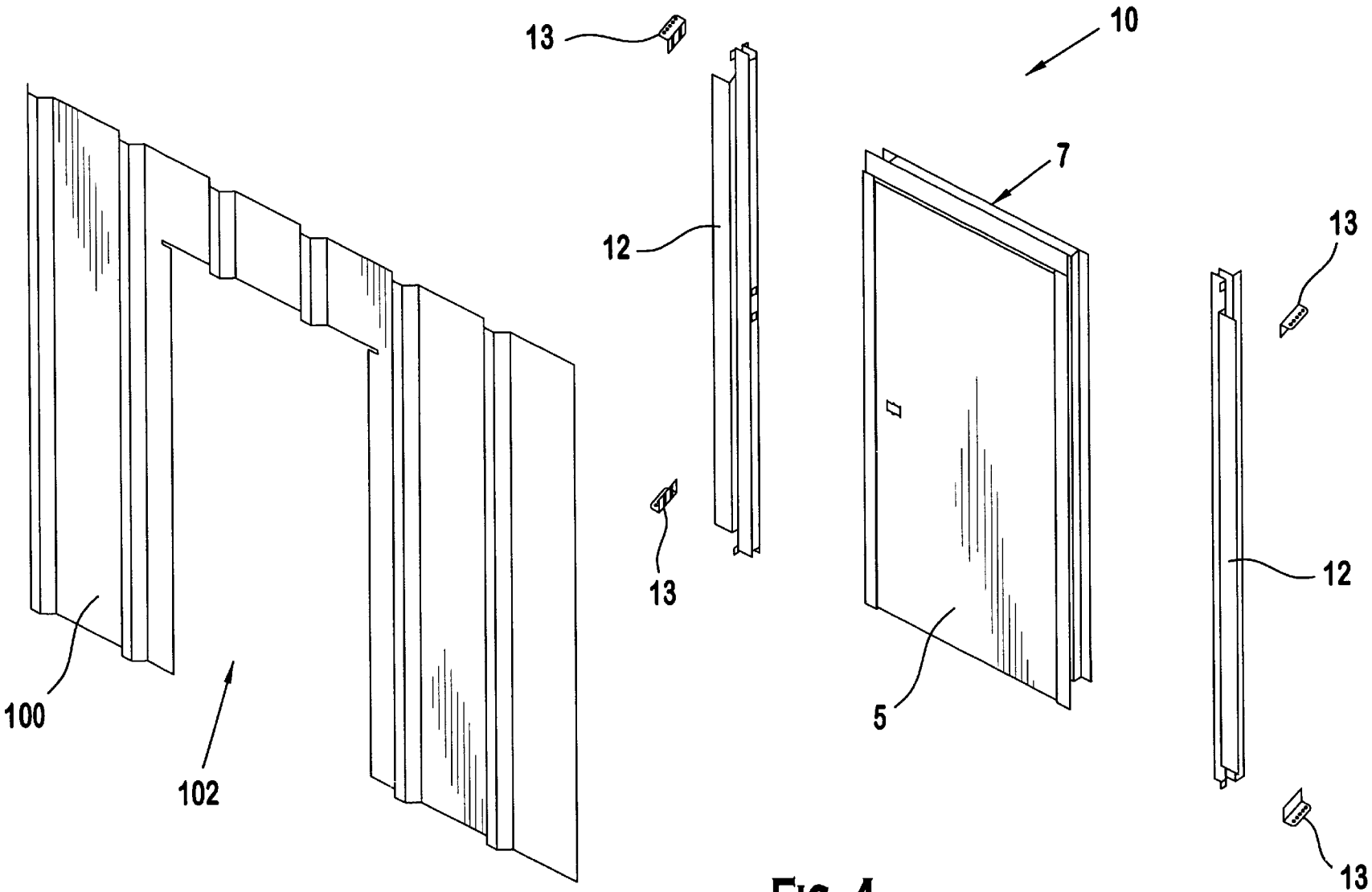
FIG. 4 is an exploded perspective view of a pre-hung door and door frame and door posts prior to installation in a pre-engineered metal building door opening.

FIG. 4 shows a pre-hung door and frame 10 (consisting of door 5 and frame 7) and door post 12 combination of the present invention ready for installation in the door opening 102 in the pre-engineered metal building wall 100. Also shown are anchors 13 that fasten the door posts 12 to the metal building.

Figure 5:
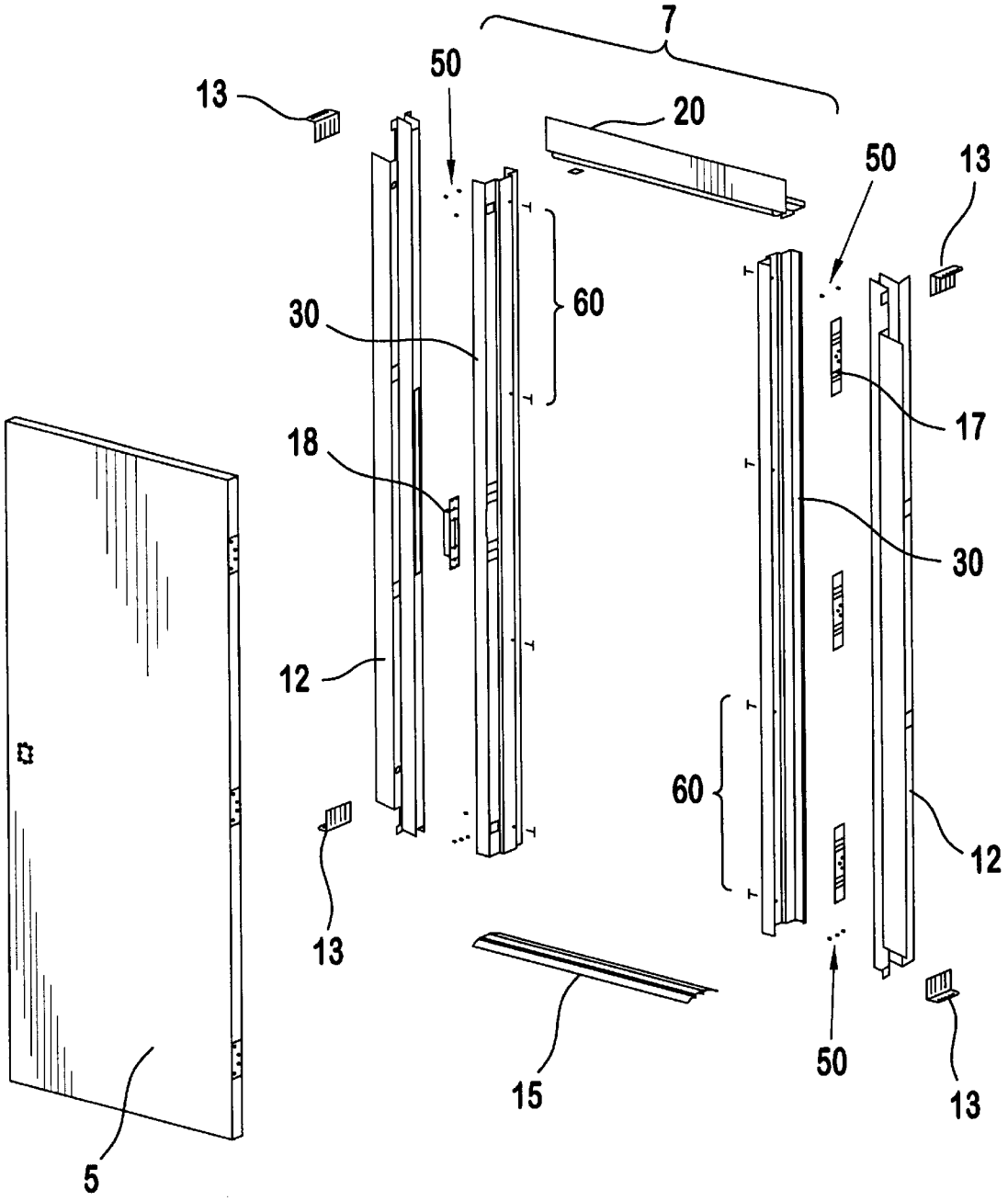
FIG. 5 is an exploded perspective view of the door frame shown in FIG. 4 along with the door and door posts.
Figure 6:
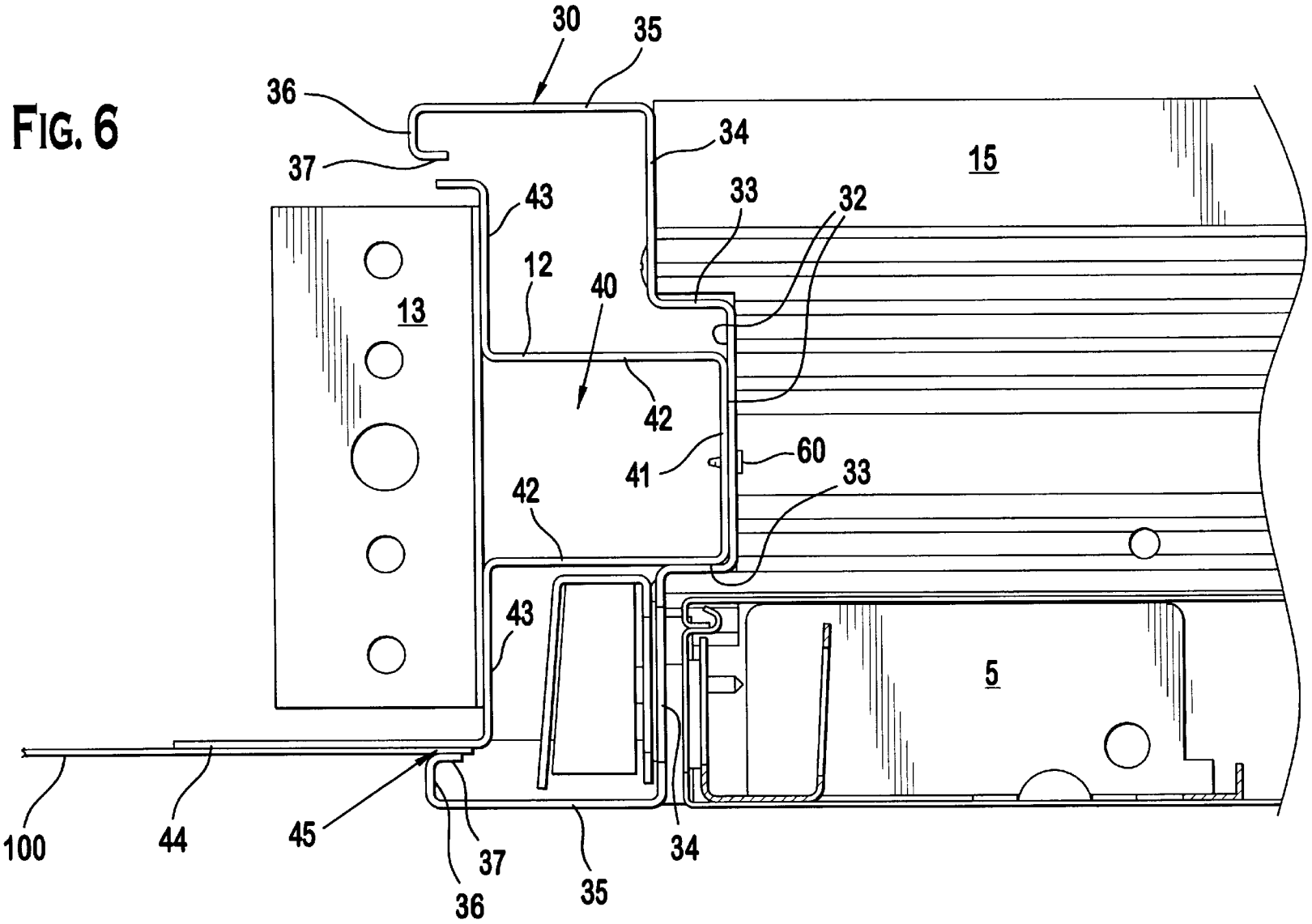
FIG. 6 is a cross-sectional view of the door post, door jamb, and door shown in FIG. 4 illustrating the installed positions of the door post and door jamb.
Figure 6A:
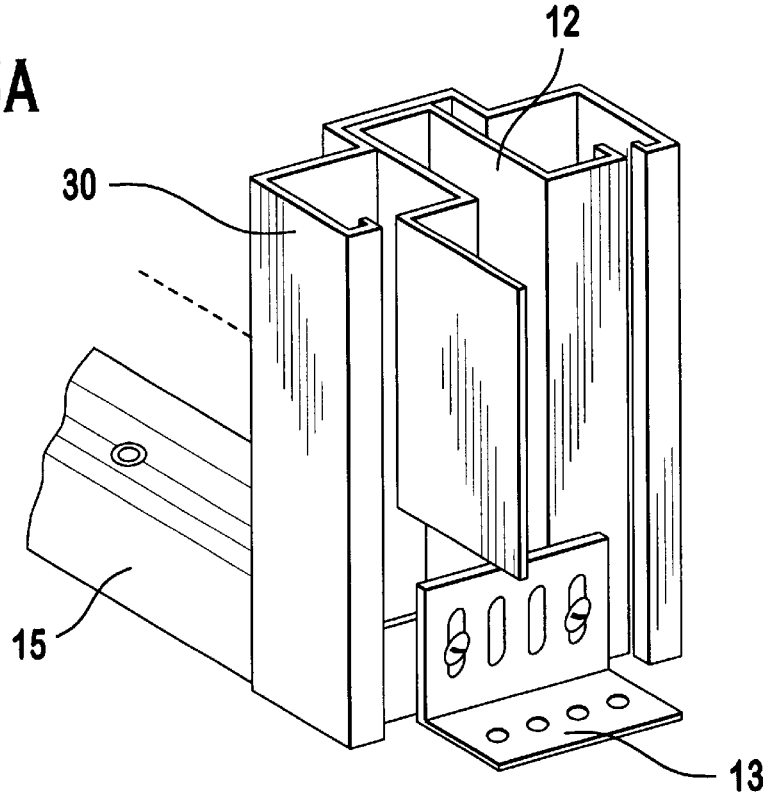
FIG. 6A is a perspective view of the door jamb and door post shown in FIG. 6.
Figure 7D:
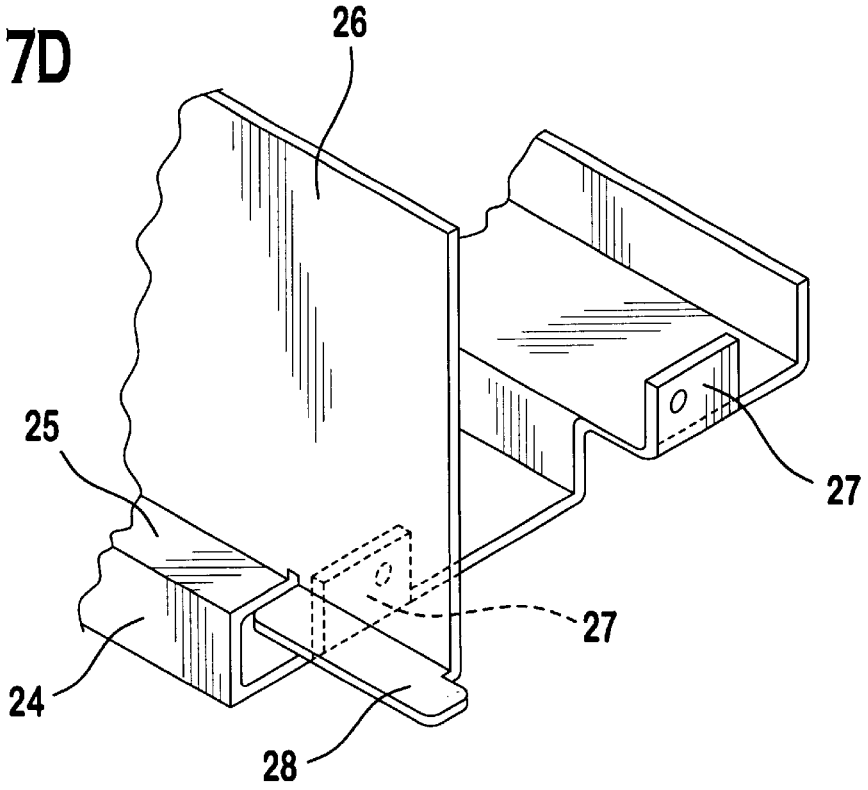
FIG. 7D is a perspective view of the header shown in FIG. 7A illustrating the header tab and door jamb tabs.
Figure 7A:
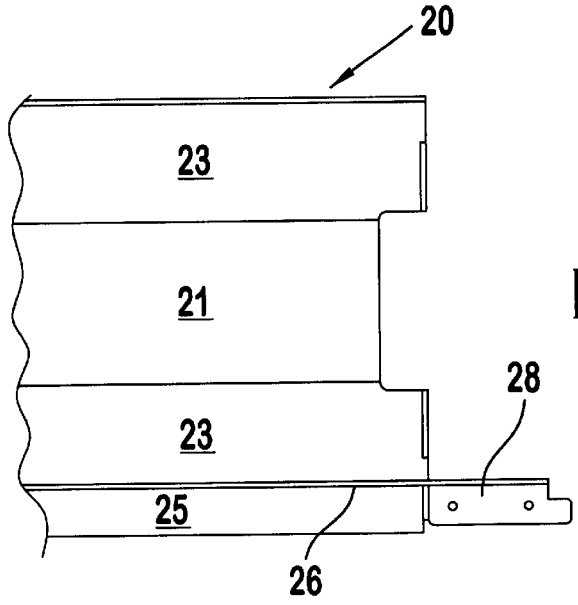
FIG. 7A is a partial top view of a door frame header showing the header tab.
Figure 7B:
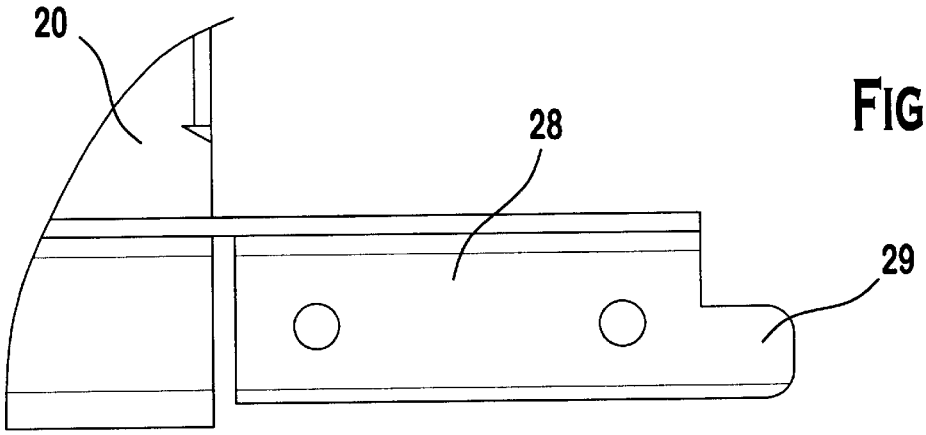
FIG. 7B is an enlarged view of the header tab shown in FIG. 7A.
Figure 7C:
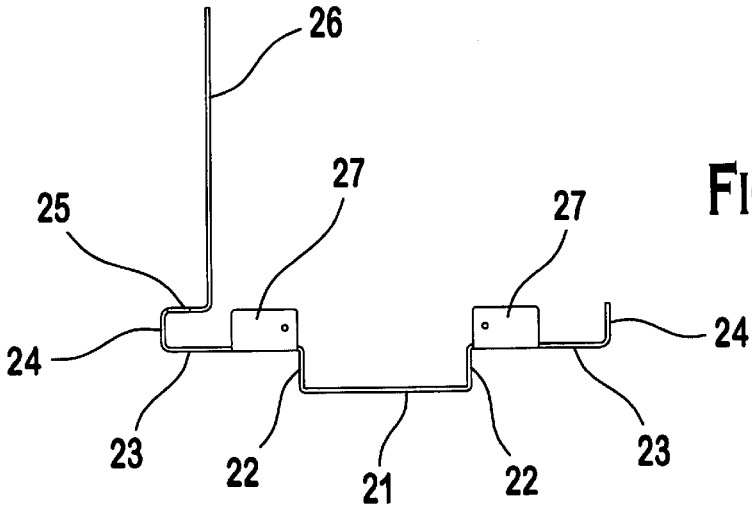
FIG. 7C is an end view of a door frame header showing the door jamb tabs.

Referring to FIGS. 5–6, the door frame 7 consists of a header 20 fastened to two jambs 30 that in turn are fastened to a sill 15. Each jamb 30 consists of a central soffit 32 with stops 33 extending at right angles away from the outside surface of the soffit 32. A rabbet 34 extends away from each stop 33 at a right angle to the stop 33 (parallel to and offset from the soffit 32). Outside faces 35 extend at right angles to each rabbet 34 (parallel to and offset from the stops 33). A first back bend (or return) 36 extends at a right angle from each face 35. A second back bend 37 extends a right angle from each first back bend (parallel to and offset from face 35). The area defined by face 35, first back bend 36 and second back bend 37 is a header tab retainer 38 (See FIG. 6).

Figure 8:
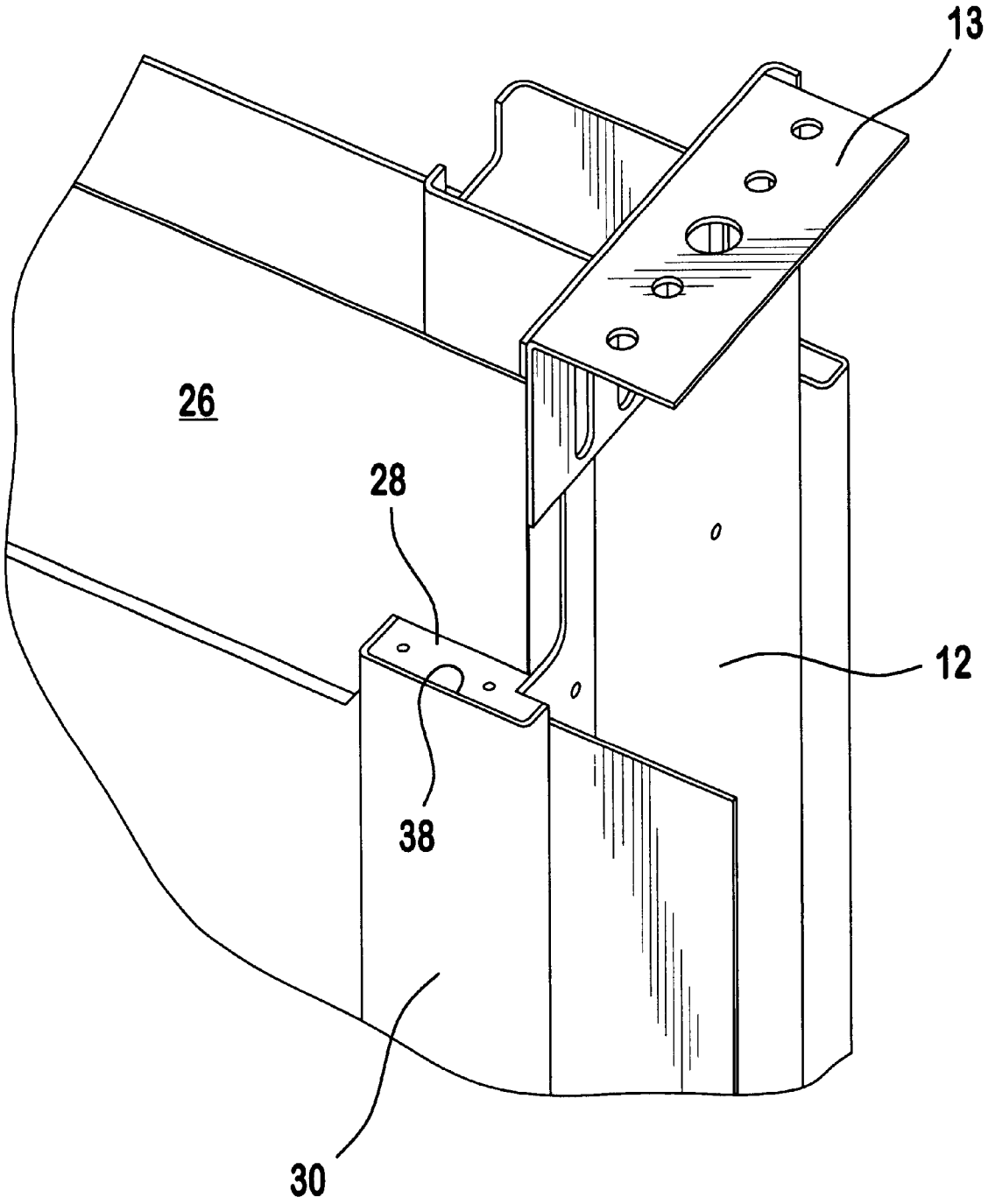
FIG. 8 is a partial perspective illustrating the header tab and header tab retainer connection.

Referring to FIGS. 7A–7D, the header 20 consists of a central soffit 21 with stops 22 extending at right angles away from the outside surface of the soffit 21. A rabbet 23 extends away from each stop 22 at a right angle to the stop 22 (parallel to and offset from the soffit 21). Outside faces 24 extend at right angles to each rabbet 23 (parallel to and offset from the stops 22). A back bend (or return) 25 extends at a right angle from one face 24. A nailing flange 26 extends away from the back bend 25 at a right angle to the back bend 25. A header tab 28 extends away from the nailing flange 26 at a right angle to the nailing flange 26 (parallel to and offset from the rabbet 23). The header tab 28 extends away from the end of the header 20 (see FIGS. 7A and 7C). The header tab 28 has a finger 29 extending away from the header tab 28. The header tab 28 and finger 29 fit into the header tab retainer 38 on the door jamb 30 when the header 20 and door jamb 30 are assembled (See FIG. 8). In addition, a pair of door jamb tabs 27 (monolithic with the header 20) extend at right angles from each rabbet 23. The door jamb tabs 27 are parallel to the door jamb rabbets 34 when the header 20 and door jamb 30 are assembled. The header 20 is then fastened to the door jamb 30 by fasteners 50.

Figure 5A:
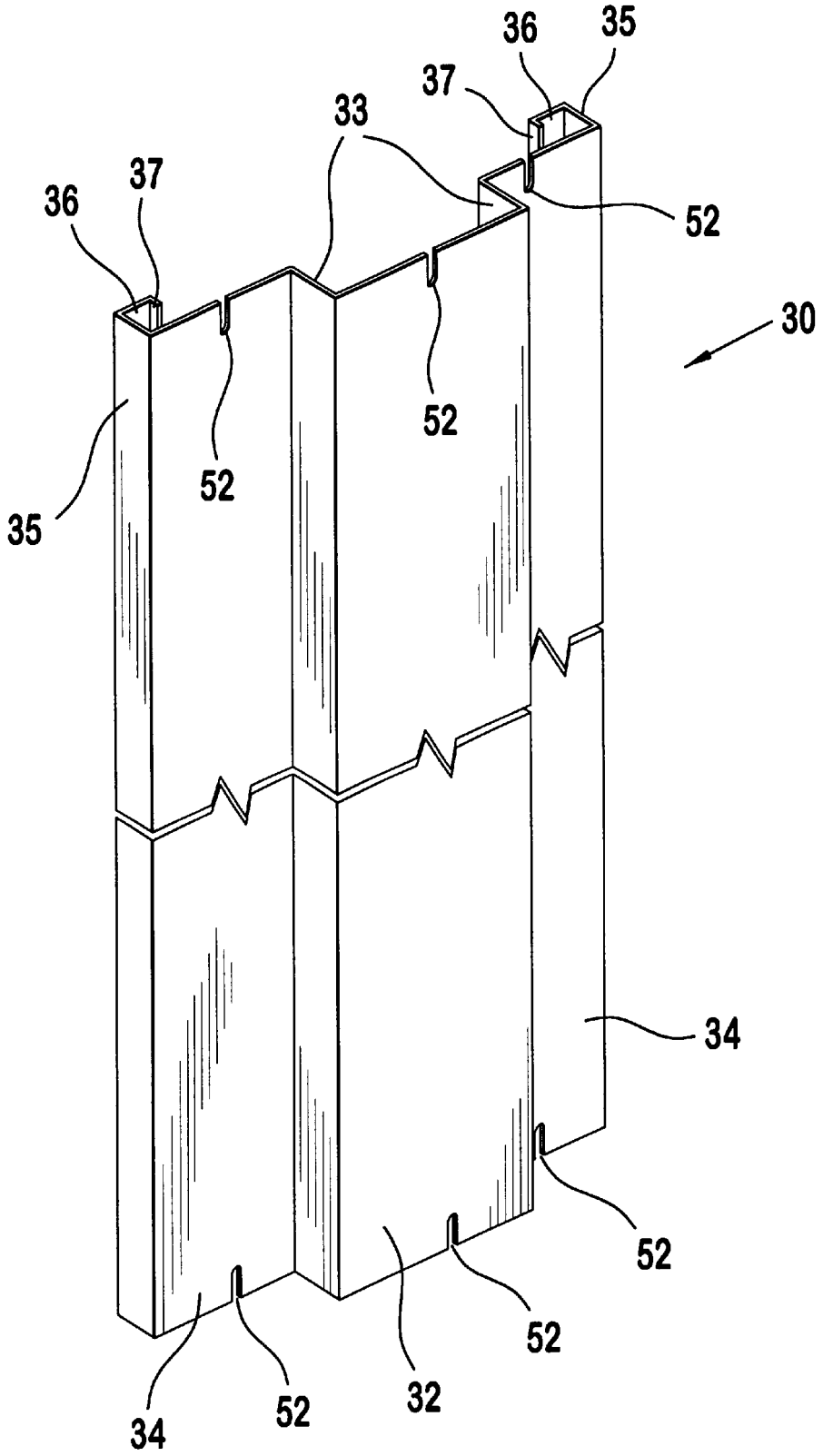
FIG. 5A is a perspective view of a preferred embodiment of a door jamb in accordance with the present invention.

One of the jambs 30 has three hinge reinforcements 17 and the other of the jambs 30 includes a lock strike reinforcement 18. The door 5 is then attached to the frame 7 by hinges (not shown). At least one screw (not shown) is used to fasten the door 5 to the lock side jamb 30, thus making a complete pre-hung door and frame assembly 10. Referring to FIG. 5A, each jamb 30 preferably has a plurality of slots 52 positioned to received the header and sill receiving fasteners 50. The slots 52 allow easy rehanding of the door 5 if desired. To rehand the door 5, the fasteners 50 are loosened, the sill 15 and header 20 are slid off the jambs 30, repositioned to rehand the door 5 as desired, and resecured with the fasteners 50.

Referring to FIG. 6, each door post 12 consists of a central channel 40 having an outer face 41. Two sides 42 extend away from the outer face 41 at right angles to the outer face 41. A rabbet 43 extends away from each side 42 at a right angle to face 42. Nailing flange 44 extends away from one of the rabbets 43, also at a right angle rabbet 43. The outer face 41 of the channel 40 contacts either the jamb soffit 32 or one of the jamb rabbets 34 and preferably the jamb soffit 32. Also, preferably, at least a portion of one of the sides 42 contacts one of the jamb stops 33. The contact on two adjacent surfaces of channel 40 provides additional strength and torsional rigidity to the door jambs 30. Preferably, channel 40 is a "deep" channel, i.e., the depth of the channel (in the direction of extension towards the jamb 30) is greater than the width of the channel 40. Such depth allows the channel 40 to receive insulation (not shown) without compressing the insulation.

The door and frame assembly 10 is installed in a cut-out 102 in a metal wall 100 of a pre-engineered building by sliding the assembly 10 into the cut-out and centering the assembly 10 in the cut-out. A door post 106 is positioned adjacent each jamb 30 such that the metal wall 100 material of the building is positioned in gap 45 (see FIG. 6) between a return or back bend 37 on the door jamb 30 and a nailing flange 44 on the door post 12. In addition, a nailing flange 26 on the header 20 is positioned behind the metal wall 100 material. The door posts 12 are slid into contact with the interior surfaces of door jambs 30 and secured directly thereto, via fastening means 60, thereby eliminating the need for any clips or anchors. The door posts are also fastened to the floor and girt by anchors 13. The door posts 12 extend longer than the door jambs 30, thereby eliminating the typical long anchors of the prior art door posts required to attach the posts to the girt.

Having described the invention, what is claimed is:

1. In combination:

a pre-assembled door frame for installation in a metal wall of a pre-engineered building and comprising a header interconnected between two door jambs, each door jamb comprising an elongated member having a given configuration with an internal surface;

two door posts, each door post adapted for securement to the pre-engineered building and configured to nest within a respective door jamb with a portion of the post in contact with at least a portion of the jamb internal surface and a second portion adjacent a portion of the corresponding door jamb such that a wall receiving and retaining gap is defined between the second portion and the portion of the corresponding door jamb; and fastening means extending between each post and respective jamb within the contact area to interconnect each post and respective jamb.

2. The combination according to claim 1, wherein each door jamb elongated member includes a soffit, two stops extending at right angles from the soffit, a rabbet extending at a right angle from each stop and a face extending at a right angle from each rabbet.

3. The combination according to claim 2, wherein each door post comprises an elongated member having a central channel extending therefrom towards the door jamb internal surface and having an outer face in contact with one of the soffit or the rabbets.

4. The combination according to claim 3, wherein the central channel has depth in the direction the central channel extends towards the door jamb and a width, the depth being greater than the width such that the channel is sized to receive insulation material.

5. The combination according to claim 3, wherein the central channel has two side surfaces extending at right angles away from the outer face, at least a portion of at least one side surface being in contact with one of the stops.

6. The combination according to claim 1, wherein the header further comprises an elongated member having a soffit, two stops extending at right angles from the soffit, a rabbet extending at a right angle from each stop, a face extending at a right angle from each rabbet and at each end of the header, an integral door jamb tab extending at a right angle from each rabbet, the door jamb tabs being parallel to the door jamb rabbet.

7. The combination according to claim 6, further comprising a plurality of fasteners attaching the door jamb tabs to the door jambs.

8. The combination according to claim 1, wherein each jamb has a given length and each door post has a length greater than the respective door jamb.

9. In combination:

a pre-hung door and frame for installation in a metal wall of a pre-engineered building and comprising a header interconnected between two door jambs, each door jamb comprising an elongated member having a given configuration with an internal surface;

two door posts, each door post adapted for securement to the pre-engineered building and configured to nest within a respective door jamb with a portion of the post in contact with at least a portion of the jamb internal surface and a second portion adjacent a portion of the corresponding door jamb to define a wall receiving and retaining gap; and fastening means extending between each post and respective jamb within the contact area to interconnect each post and respective jamb wherein each door jamb elongated member comprises a soffit, two stops extending at right angles from the soffit, a rabbet extending at a right angle from each stop, a face extending at a right angle from each rabbet, a first back bend extending at a right angle from one of the faces, the first back bend being parallel to the rabbets and a second back bend extending at a right angle from the first back bend towards the rabbet, the second back bend being parallel to the faces; a rabbet, a face, a first back bend and a second back bend defining a header tab retainer; and the header further comprising an elongated member having a soffit, two stops extending at right angles from the soffit, a rabbet extending at a right angle from each stop, face extending at a right angle from each rabbet, a back bend extending at a right angle from one of the faces, the back bend being parallel to the rabbets, a nailing flange extending away from the soffit at a right angle from the back bend, a header tab extending from the nailing flange with a portion substantially parallel to the soffit, the portion of the header tab substantially parallel to the soffit being received in the door jamb header flange retainer and thereby reducing the potential for twisting of the jamb.

10. The combination according to claim 9, wherein the header tab comprises a rectangular portion and a finger portion extending away from the rectangular portion such that the header tab has a configuration which complements the configuration of the door jamb header flange retainer.

11. A door frame comprising:

a header comprising an elongated member having a soffit, two stops extending at right angles from the soffit, a rabbet extending at a right angle from each stop, a face extending at a right angle from each rabbet, a back bend extending at a right angle from one of its faces, the back bend being parallel to the rabbets, a nailing flange extending away from the soffit at a right angle from the back bend, and a header tab extending from the nailing flange with a portion substantially parallel to the soffit; and two door jambs, each at a right angle to the header and comprising an elongated member having a soffit, two stops extending at right angles from the soffit, a rabbet extending at a right angle from each stop, a face extending at a right angle from each rabbet, a first back bend extending at a right angle from each face, the first back bend parallel to the rabbets and a second back bend extending at a right angle from each first back bend towards the rabbet, the second back bend being parallel to the faces; a rabbet, a face, a first back bend and a second back bend defining a header tab retainer; an upper end of each door jamb being attached to the header, the portion of the header tab substantially parallel to the soffit being received in the door jamb header flange retainer.

12. The combination according to claim 11, wherein the header tab comprises a rectangular portion and a finger portion extending away from the rectangular portion such that the header tab has a configuration which complements the configuration of the door jamb header flange retainer.

13. The combination according to claim 11, wherein the header further comprises an integral door jamb tab extending at a right angle from each header rabbet, the door jamb tabs being parallel to the door jamb rabbet.

14. In combination:

a pre-assembled door frame comprising: a header; two door jambs at a right angle to the header, each door jamb comprising an elongated member having a soffit, two stops extending at right angles from the soffit, a rabbet extending at a right angle from each stop and a face extending at a right angle from each rabbet, an upper end of each door jamb being attached to the header; and a door hingedly attached to one of the door jambs; and two door posts, the door posts nesting within the door jambs, each door post comprising an elongated member having a central channel extending therefrom towards an inner surface of the door jamb, having an outer face in contact with the soffit and having two side surfaces, with a fastening means interconnecting the post and jamb at such spot, and extending at right angles away from the outer face, at least a portion of one side surface being in contact with one of the stops and a second portion of the post adjacent a portion of the corresponding door jamb such that a wall receiving and retaining gap is defined between the second portion and the portion of the corresponding door jamb.

15. A door frame comprising:

a header having first and second ends with a tightenable fastener extending from each end;

a sill having first and second ends with a tightenable fastener extending from each end;

a pair of jambs, each jamb having a body extending between opposed first and second ends; and an open ended slot positioned at and opening toward each end of each jamb, each slot configured to receive a header or sill fastener;

whereby the frame is assembled by sliding the header fasteners into the respective slots at the first ends of the jambs and sliding the sill fasteners into the respective slots at the second ends of the jambs.

* * * * *